US008760316B2

(12) United States Patent
Kohli et al.

(10) Patent No.: US 8,760,316 B2
(45) Date of Patent: Jun. 24, 2014

(54) ENHANCED TRANSPONDER PROGRAMMING IN AN OPEN ROAD TOLL SYSTEM

(75) Inventors: Japjeev Kohli, Waterloo (CA); Alastair Malarky, Petersburg (CA)

(73) Assignee: Kapsch Trafficcom Canada Inc., Mississauga (CA)

( * ) Notice: Subject to any disclaimer, the term of this patent is extended or adjusted under 35 U.S.C. 154(b) by 1012 days.

(21) Appl. No.: 12/728,017

(22) Filed: Mar. 19, 2010

(65) Prior Publication Data

US 2010/0245126 A1 Sep. 30, 2010

Related U.S. Application Data

(60) Provisional application No. 61/161,896, filed on Mar. 20, 2009.

(51) Int. Cl.
*G08G 1/065* (2006.01)

(52) U.S. Cl.
USPC ..... 340/928; 340/907; 340/933; 340/10.1; 340/10.41; 235/382; 235/384; 701/24

(58) Field of Classification Search
USPC ..... 340/928, 905, 907, 933, 936, 941, 10.1, 340/10.2, 10.41, 572.1, 669, 391; 701/24, 701/117, 119, 207; 455/41.2, 96, 99, 406, 455/407, 418, 345, 558; 235/382, 384; 342/44, 442
See application file for complete search history.

(56) References Cited

U.S. PATENT DOCUMENTS

| | | | | |
|---|---|---|---|---|
| 5,164,732 | A * | 11/1992 | Brockelsby et al. | 342/44 |
| 5,227,803 | A * | 7/1993 | O'Connor et al. | 342/442 |
| 6,661,352 | B2 * | 12/2003 | Tiernay et al. | 340/928 |
| 2006/0071816 | A1 | 4/2006 | Tang et al. | |
| 2006/0202800 | A1 * | 9/2006 | Ohashi et al. | 340/10.1 |
| 2007/0063872 | A1 * | 3/2007 | Ho et al. | 340/928 |
| 2009/0184847 | A1 * | 7/2009 | Kohli et al. | 340/989 |

OTHER PUBLICATIONS

European Patent Office, "European Search Report", issued in connection with Application No. 10753032, Oct. 2, 2013, (7 pages).

* cited by examiner

*Primary Examiner* — Travis Hunnings
*Assistant Examiner* — Sisay Yacob
(74) *Attorney, Agent, or Firm* — Hanley, Flight & Zimmerman, LLC

(57) ABSTRACT

A transponder communication system and method for communicating with a transponder in an electronic toll collection system. A roadside reader attempts to program the transponder in a normal mode in which a programming signal is transmitted to a first coverage area. If the programming attempt in the normal mode is unsuccessful, the reader attempts to program the transponder in an enhanced mode in which a programming signal is transmitted to a second coverage area. The coverage area is adjusted after the programming attempt in the normal mode by using an adjacent antenna to the antenna used to transmit in the normal mode or by increasing the power of the programming signal to a level that is greater than the level used to transmit the programming signal in the normal mode.

12 Claims, 10 Drawing Sheets

ENHANCED TRANSPONDER PROGRAMMING IN AN OPEN ROAD TOLL SYSTEM

CROSS-REFERENCE TO RELATED APPLICATIONS

The present application claims priority to U.S. provisional patent application No. 61/161,896 filed Mar. 20, 2009.

FIELD

The present invention relates to electronic toll collection systems and, in particular, to methods and systems for communicating with a transponder located on or within a moving vehicle traveling on a roadway.

BACKGROUND

Electronic toll collection ("ETC") systems are commonly used to facilitate the collection of a toll from a moving vehicle traveling on a toll-roadway.

In a typical ETC system, a series of antennas are mounted near the roadway to provide overlapping coverage zones. Radio frequency ("RF") transponders are mounted on or within a vehicle to communicate with the antennas as they pass through the coverage zone for the antenna. A roadside Automatic Vehicle Identification ("AVI") reader causes each antenna to transmit an RF trigger or wakeup signal within the coverage zone. A transponder passing through the coverage zone detects the wakeup or trigger signal and responds with its own RF signal. The response signal typically includes information stored in a transponder memory, such as an identification number associated with the transponder. In some systems, the roadside reader may be connected to a vehicle detector and imaging system which permits vehicles to be detected, classified, and photographed, and the license plate numbers analyzed in order to permit the operator of the toll system to apply appropriate charges to the owner of the vehicle.

The AVI reader typically includes software for determining a probable lane position of the vehicle. After the AVI reader has read the data transmitted by the transponder, the reader typically transmits updated information to the transponder using an antenna having a coverage zone which includes the probable position of the vehicle, as determined by the software for determining the probable lane position of the vehicle. For example, the reader may transmit a timestamp and/or a lane and Plaza ID identifying the lane and plaza which the transponder has passed through. When the transponder receives the updated information, it typically stores the updated information in the transponder memory.

In some circumstances, a transmission problem may occur resulting in a failed programming attempt. For example, the transponder may not receive a signal if the transponder has traveled outside of the coverage area of the antenna used to transmit the programming signal. Interference caused by other electrical devices may also result in the programming signal or a portion of the programming signal not being received by the transponder. A transmission error may also occur due to reflections, multipath and the attenuation of the RF programming signal as it passes from the exterior of the vehicle to the interior of the vehicle where the transponder is typically located.

It is therefore desirable to provide an improved method and system for communicating with a transponder located in a moving vehicle in a toll roadway.

SUMMARY

The present application describes systems and methods for communicating with a transponder located in or on a moving vehicle traveling in a roadway.

In one aspect, the present application provides a transponder communication system for use in an electronic toll collection system for programming a transponder located in a moving vehicle travelling in a roadway. The transponder has a memory. The system includes a plurality of antennas having a coverage area that includes at least a portion of the roadway for transmitting a programming signal and receiving a response signal from the transponder to indicate a successful programming of the transponder. The system also includes a control device connected to the antennas. The control device is configured to direct at least one of the antennas to transmit the programming signal in a normal mode over a first coverage area. The control device is configured to subsequently wait for the response signal and determine whether the transponder has updated its memory using the programming signal. The control device is further configured to direct at least one of the antennas to transmit the programming signal in an enhanced mode if the control device determines that the transponder failed to update its memory. In the enhanced mode, the programming signal is transmitted over a modified coverage area.

In another aspect, the present application provides a method for programming a transponder in a moving vehicle in a roadway. The roadway has at least one antenna having a coverage area that includes at least a portion of the roadway. The transponder has a memory. The transponder is configured to program the memory upon receiving a programming signal. The method comprising the steps of: a) transmitting the programming signal in a normal mode over a first coverage area using at least one of the roadway antennas; b) verifying that the transponder has programmed the transponder memory using the programming signal; and c) transmitting the programming signal in an enhanced mode over a modified coverage area using at least one of the roadway antennas if unable to verify that the transponder has programmed the transponder memory.

In a further aspect, the present application provides a transponder communication system for use in an electronic toll collection system for communicating with a plurality of transponders located in moving vehicles travelling in a roadway. Each of the transponders has a memory having data stored thereon. The system includes a plurality of antennas having a coverage area that includes at least a portion of the roadway for transmitting signals to the transponders and for receiving signals transmitted by the transponders. The system also includes a control device connected to the antennas. The control device is configured to operate the antennas in a time division multiplexed sequence. The time division multiplexed sequence has successive superframes of equal duration. Each superframe is comprised of a series of frames. Each frame in the series corresponding to communications on a different one of the antennas. The control device is configured to allocate a predetermined number of frames in each superframe as reading slots for reading data from the memory of the transponders and to allocate a predetermined number of frames in each superframe as writing slots for writing data to the memory of the transponders.

In yet a further aspect, the present application provides a method of directing communications with transponders in moving vehicles in a roadway. The roadway has a plurality of antennas having a coverage area that includes at least a portion of the roadway. The antennas are configured to operate in a time division multiplexed sequence. The time division multiplexed sequence is comprised of successive superframes. Each superframe is comprised of a series of frames. Each frame corresponds to communications on one of the antennas. Each superframe has a fixed number of frames available for reading data from a memory of the transponder and a fixed number of frames available for writing data to the memory of the transponder. The method comprises the steps of: a) determining which of the transponders need to be programmed; b) selecting for immediate programming at least some of the transponders that need to be programmed based on the fixed number of frames available for writing data; c) determining which of the antennas to use for communicating with the transponders that need to be programmed; d) determining which frames correspond to the antennas to be used; e) allocating the frames of a first superframe which have been determined to correspond to the antennas to be used as writing slots, for writing data to the memory of the transponder; and f) allocating a predetermined number of the unallocated frames of the superframe as reading slots.

In yet a further aspect, the present application provides a transponder communication system for use in an electronic toll collection system for communicating with a plurality of transponders located in moving vehicles travelling in a roadway. Each of the transponders has a memory having data stored thereon. The system includes a plurality of antennas having a coverage area that includes at least a portion of the roadway for transmitting signals to the transponders and for receiving signals transmitted by the transponders. The system also includes a control device connected to the antennas. The control device is configured to operate the antennas in a time division multiplexed sequence. The time division multiplexed sequence has successive hyperframes of equal duration. Each hyperframe is comprised of a series of superframes. The series of superframes includes a first superframe comprised of a series of frames. Each frame in the first superframe corresponds to a period for communicating on a different one of the antennas. Each frame in the first superframe is a reading slot for reading data from the memory of the transponders. The series of superframes further comprises a second superframe comprised of a second series of frames. Each frame in the second superframe corresponds to a period for communicating on a different one of the antennas. Each frame in the second superframe includes a reading slot for reading data from the memory of the transponders and a writing slot for writing data to the memory of the transponders.

In another aspect, the present application provides a transponder communication system for use in an electronic toll collection system for programming a transponder located in a moving vehicle travelling in a roadway. The transponder has a memory. The system includes a plurality of narrow beam reading antennas. Each antenna has a coverage area that includes at least a portion of the roadway for transmitting trigger signals and receiving signals transmitted by the transponders in response to the trigger signal. The system also includes at least one wide beam programming antenna which has a coverage area that includes at least a portion of the roadway for transmitting signals to the transponders. The coverage area of the wide beam antenna is larger than the coverage area of any one of the narrow beam antennas. The system also includes a control device connected to the antennas. The control device is configured to control communications on the antennas. The control device is configured to initiate a reading sequence by causing one of the narrow beam antennas to transmit a trigger signal and awaiting a response on that antenna. The control device is further configured to initiate a writing sequence by causing the wide beam antenna to transmit a programming signal.

Other aspects and features of the present application will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show an embodiment of the present application, and in which.

DESCRIPTION OF SPECIFIC EMBODIMENTS

Figure 1:
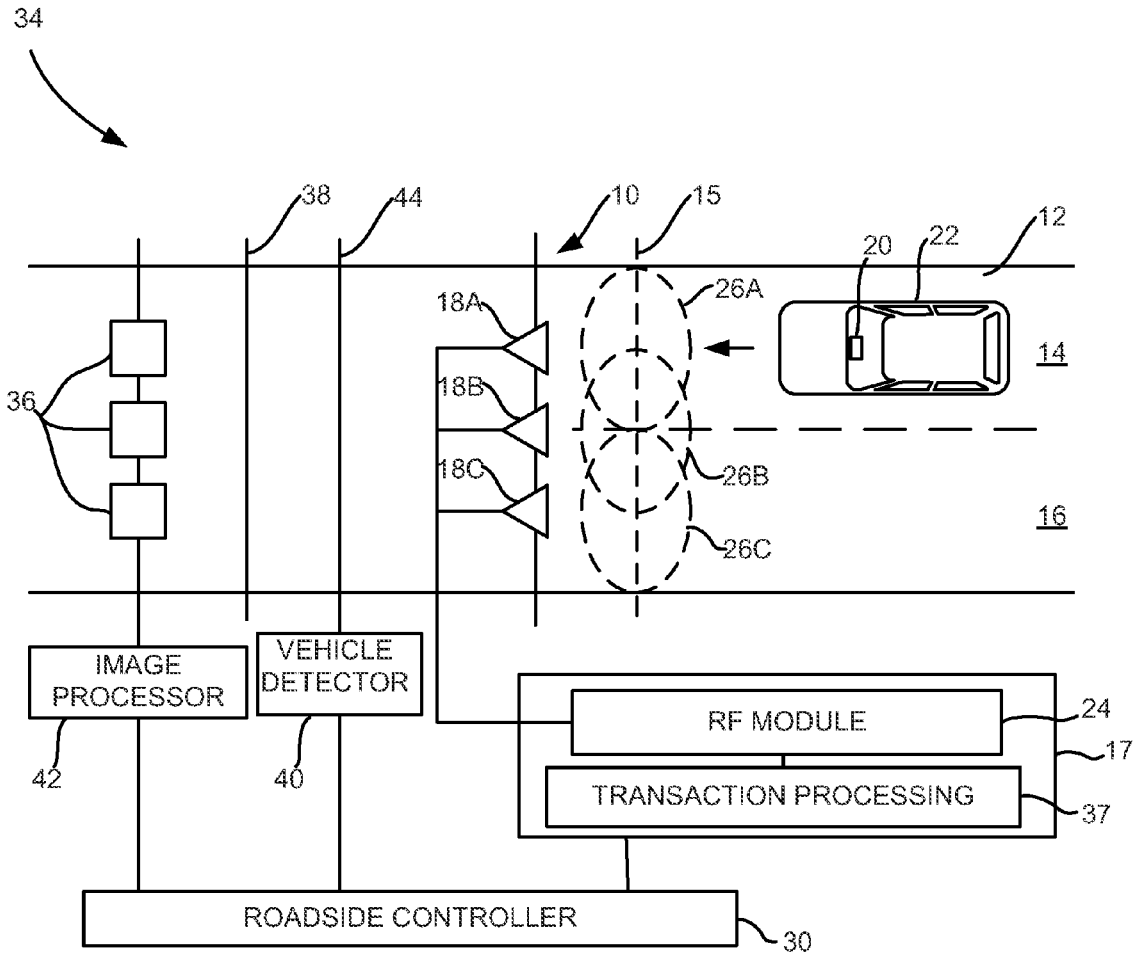
FIG. 1 shows a plan view and a block diagram of an example embodiment of a transponder communication system in a two-lane open road toll application.

With reference to FIG. 1, there is shown an embodiment of an electronic toll collection system having a transponder communication system, illustrated generally by reference numeral 10. In one embodiment, the electronic toll collection system is associated with a gated toll plaza. In another embodiment, the system is associated with an open-road toll processing zone. Other applications of the electronic toll collection system will be appreciated by those skilled in the art.

As shown in FIG. 1, the electronic toll collection system is applied to a roadway 12 having first and second adjacent lanes 14 and 16. The roadway 12 may be a two lane access roadway leading towards or away from a toll highway. The electronic toll collection system 10 includes three roadway antennas 18A, 18B and 18C, each of which is connected to signal processing means, namely an Automatic Vehicle Identification ("AVI") reader 17. It will be appreciated that other antenna configurations may be used and the number of antennas or the number of lanes may be different than those illustrated in FIG. 1. For example, the exemplary embodiment of FIG. 1 could be modified to eliminate the midpoint antenna 18B so that only two roadway antennas 18A, 18C would be used to provide coverage to the two lanes 14 and 16. The antennas 18A, 18B, 18C may, in some embodiments, be mounted to an overhead gantry or other structure.

The AVI reader 17 is a control device that processes signals that are sent and received by the roadway antennas 18A, 18B and 18C. The AVI reader 17 may include a processor (not shown) and a radio frequency (RF) module 24. The processor may be configured to control communications on the antennas 18A, 18B, 18C. The processor includes a programmable processing unit, volatile and non-volatile memory storing instructions and data necessary for the operation of the processor, and communications interfaces to permit the processor to communicate with the RF module 24 and a roadside controller 30.

The RF module 24 is configured to modulate signals from the processor 35 for transmission as RF signals over the roadway antennas 18A, 18B and 18C, and to de-modulate RF signals received by the roadway antennas 18A, 18B and 18C into a form suitable for use by the processor 35. In this regard, the AVI reader 17 employs hardware and signal processing techniques that are well known in the art.

The roadway antennas 18A, 18B and 18C, and AVI reader 17 function to read information from a transponder 20 (shown in the windshield of vehicle 22), to program information to the transponder 20, and to verify that a validated exchange has taken place.

The roadway antennas 18A, 18B and 18C may be directional transmit and receive antennas which, in the illustrated embodiment, have an orientation such that each of the roadway antennas 18A, 18B and 18C can only receive signals transmitted from a transponder 20 when the transponder 20 is located within a roughly elliptical coverage zone associated with the antenna.

The roadway antennas 18A, 18B and 18C are located above the roadway 12 and arranged such that they have coverage zones 26A, 26B and 26C which are aligned along an axis 15 that is orthogonal to the travel path along roadway 12. In the embodiment illustrated, the major axes of the elliptical coverage zones 26A, 26B and 26C are co-linear with each other, and extend orthogonally to the direction of travel. As is apparent from FIG. 1, the coverage zone 26A provides complete coverage of the first lane 14, and the coverage zone 26C provides complete coverage of the second lane 16. The coverage zone 26B overlaps both of the coverage zones 26A and 26C.

It will be understood that although the coverage zones 26A, 26B and 26C are illustrated as having identical, perfect elliptical shapes, in reality the actual shapes of the coverage zones 26A, 26B and 26C will typically not be perfectly elliptical, but will have a shape that is dependent upon a number of factors, including RF reflections or interference caused by nearby structures, the antenna pattern and mounting orientation.

It will also be understood that, although elliptical coverage zones are disclosed in the above embodiment, other shapes could also be used for the coverage areas 26A, 26B or 26C. Furthermore, while three coverage areas 26A, 26B, 26C are shown, the number of coverage areas may vary.

The AVI reader 17 may also include a transaction processing module 37 for processing a payment transaction for the transponder 20. The payment transaction may be initiated in response to a receipt of data from the transponder 20. The transaction processing module 37 may be configured to issue a request for programming a specific one of the transponders 20 following the processing of the payment transaction for that transponder 20.

The AVI reader 17 is connected to a roadside controller 30. In open road toll systems, the electronic toll collection system 10 will often include a vehicle imaging system, which is indicated generally by reference numeral 34. The imaging system 34 includes an image processor 42 to which is connected a number of cameras 36, arranged to cover the width of the roadway for capturing images of vehicles as they cross a camera line 38 that extends orthogonally across the roadway 12. The image processor 42 is connected to the roadside controller 30, and operation of the cameras 36 is synchronized by the roadside controller 30 in conjunction with a vehicle detector 40. The vehicle detector 40 which is connected to the roadside controller 30 detects when a vehicle has crossed a vehicle detection line 44 that extends orthogonally across the roadway 12, which is located before the camera line 38 (relative to the direction of travel). The output of the vehicle detector 40 is used by the roadside controller 30 to control the operation of the cameras 36. The vehicle detector 40 can take a number of different configurations that are well known in the art, for example it can be a device which detects the obstruction of light by an object.

As shown in FIG. 1, the electronic toll collection system utilizes a transponder 20 that is located in a vehicle 22 traveling on the roadway 12. The transponder 20 has a modem that is configured to de-modulate RF signals received by the transponder antenna into a form suitable for use by a transponder controller. The modem is also configured to modulate signals from the transponder controller for transmission as an RF signal over the transponder antenna.

The transponder 20 also includes a memory that is connected to the transponder controller. The transponder controller may access the memory to store and retrieve data. The memory may be random access memory (RAM) or flash memory. In one embodiment, the memory is the integrated memory of a microcontroller.

The memory of the transponder 20 may have a location of memory reserved for storing data which may be altered by the AVI reader 17. This location of memory may include, for example, fields for recording entry and exit points of the vehicle 22 and times and dates of entry or exit of the vehicle 22. It may also include account information which the AVI reader 17 verifies and then debits in an automated parking system, automated drive-through retail outlet, or other mobile commerce system. In the course of an electronic tolling operation, the AVI reader 17 may need to update the memory of the transponder 20.

The memory of the transponder 20 may also contain an area of memory that cannot be updated by the AVI reader 17. For example, the memory may contain fields which are set by the manufacturer or agency deploying the transponders which tend to relate to the characteristics of the transponder 20 or the vehicle 20 a or customer.

Figure 2:
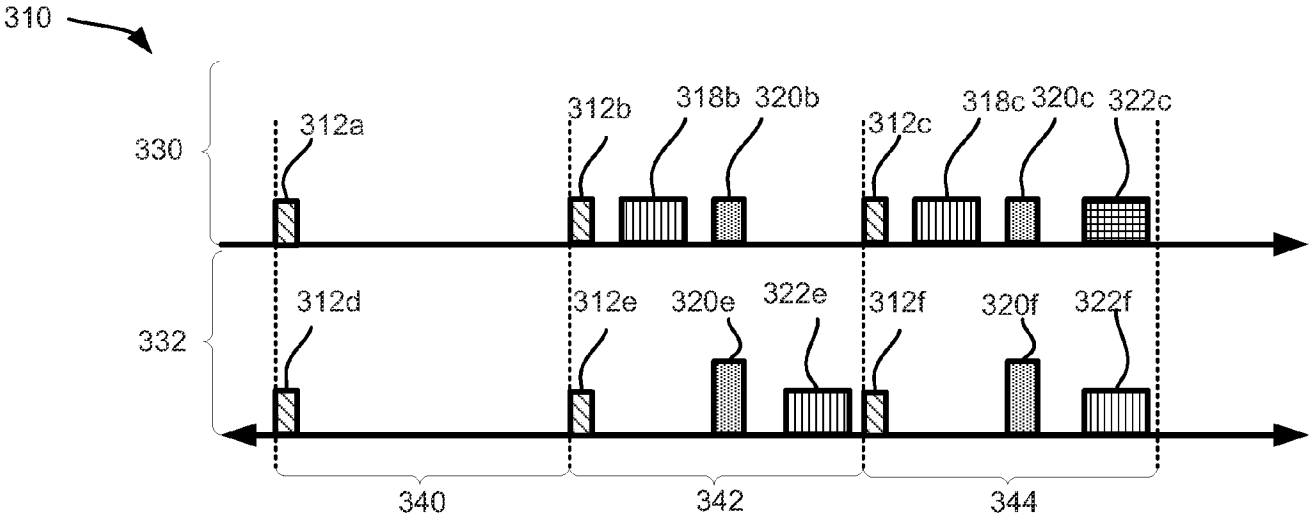
FIG. 2 shows a timing diagram of a control device of the transponder communication system of FIG. 1.

Reference is now made to FIG. 2 which shows a timing diagram 310 for an embodiment of a pre-defined communications protocol for the electronic toll collection system described above. In the embodiment shown in FIG. 2, the AVI reader 17 is configured to operate the antennas 18A, 18B, 18C in a time division multiplexed sequence having successive superframes 330, 332. The AVI reader 17 is configured such that the second superframe 332 occurs immediately after the first superframe 330.

The timing diagram 310 illustrates an exemplary timing sequence of communication operations for two superframes 330, and 332. Each superframe is comprised of a series of frames 340, 342, 344. Each frame 340, 342, 344 in each superframe 330, 332 corresponds to communications on a different one of the antennas 18A, 18B, 18C. For example, the first frame 340 of each superframe 330, 332 may correspond to communications on the first antenna 18A and the second frame 342 of each of superframe 330, 332 may correspond to communication the second antenna 18B, and the third frame 344 of each superframe 330, 332 may correspond to communications on the third antenna 18C.

Each frame 340, 342, 344 of the timing diagram 310 includes a trigger signal 312*a*, 312*b*, 312*c*, 312*d*, 312*e*, 312*f* which is transmitted by the AVI reader 17 to the transponder 20, using the corresponding antennas 18A, 18B, 18C. For example, in the example discussed above, where the first frame 340 corresponds to communications on the first antenna 18A, the trigger signal 312*a* in the first frame 340 of the first superframe 330 and the trigger signal 312*d* of the first frame 340 of the second superframe 332 are transmitted using the first antenna 18A.

In the embodiment illustrated in FIG. 2, each of the frames 340, 342, 344 are of the same duration and are of sufficient duration to permit reading, programming, and verifying operations to occur during each frame 340, 342, 344.

The transponders 20 are configured to transmit a memory content signal 318*b*, 318*c* following the receipt of the trigger signal 312*a*, 312*b*, 312*c*, 312*d*, 312*e*, 312*f*. The memory content signal 318*b*, 318*c* includes at least some of the contents of the transponder memory 20.

Following the transmission of the trigger signal 312*a*, 312*b*, 312*c*, 312*d*, 312*e*, 312*f*, the AVI reader 17 is configured to subsequently wait for the memory content signal 318*b*, 318*c*. If the memory content signal 318*b*, 318*c* is not received after a predetermined period of time, the AVI reader 17 may determine that there is no transponder in the vicinity of the reader's transmission range that has received the trigger signal 312*a*, 312*b*, 312*c*, 312*d*, 312*e*, 312*f*. For example, such a situation is illustrated as occurring in the first frame 340 of the first superframe 330 of FIG. 2.

In some frames, the memory content signal 318*b*, 318*c* may be received by the AVI reader 17 from transponders 20 which are within the coverage area 26A, 26B, 26C of the antenna 18A, 18B, 18C used to transmit the trigger signal 312*a*, 312*b*, 312*c*. For example, in the exemplary timing diagram 310 of FIG. 2, memory content signals 318*b*, 318*c* are received in the second frame 342 of the first superframe 330 and in the third frame 344 of the first superframe 330.

Following the receipt of the memory content signal 318*b*, 318*c*, there may be a delay during which the transaction processing module 37 may process a payment transaction. For example, the transaction processing module 37 may debit a toll amount from an account associated with the transponder 20.

After the transaction processing module 37 has processed the payment transaction, the AVI reader 17 may need to update the contents of the memory of the transponder 20. In order to update the contents of the memory of the transponder 20, the AVI reader 17 transmits a programming signal 320 in a normal mode using one or more of the antennas 18A, 18B, or 18C. In one embodiment, shown in FIG. 2, the AVI reader may cause a programming signal 320*b*, 320*c* to be transmitted in the normal mode using the antenna 18B, 18C associated with the frame 342, 344 during which the memory content signal 318*b*, 318*c* was received. For example, in FIG. 2, an example is illustrated where, the AVI reader 17 transmits a first programming signal 320*b* in the normal mode on the second antenna 18B after the memory content signal 318*b* is received in the second frame 342 of the first superframe 330 at the second antenna 18B.

In other embodiments (not shown), the AVI reader 17 is equipped with a vehicle position determination system to determine a likely location of the vehicle 22 containing the transponder 20. Various methods of determining the position of the vehicle are known. For example, in one embodiment, the AVI reader 17 will perform the steps of transmitting a trigger signal and waiting for a response signal many times on each antenna and will receive multiple responses from the transponder 20, in order to locate the lane position of the transponder 20. It will be appreciated that other methods may be used to determine which antenna 18A, 18B or 18C is the most likely to have a coverage area 26A, 26B, or 26C which includes the current position of the vehicle 22 carrying the transponder 20. One method is disclosed in U.S. Pat. No. 6,219,613, entitled "VEHICLE POSITION DETERMINATION SYSTEM AND METHOD", filed Apr. 18, 2000, which is incorporated by reference.

In embodiments where a vehicle position determination system is employed, a first programming signal 320*b*, 320*c* may be transmitted using the antenna 18A, 18B or 18C that is determined by the vehicle position determination system to be best suited for communicating with the transponder 20.

In some situations, there may be multiple transponders 20 within the coverage area 26A, 26B, or 26C of the antenna 18A, 18B, or 18C used to transmit the programming signal. In order to ensure that the programming signal 320 is only used by the appropriate transponder 20, the programming signal 320 includes a transponder ID, identifying the transponder 20 for which the programming signal 320 is intended.

It will also be understood that the AVI reader 17 may receive multiple memory content signals 318 from a given transponder 20 as that transponder 20 passes through the coverage zones 26A, 26B, 26C. The memory content signal 318 may be received in multiple superframes 330, 332. The memory content signal 318 for a given transponder 20 may also be received at multiple antennas 18A, 18B and 18C. This may occur, for example, when the transponder 20 is located in an area of overlapping coverage zones 26A, 26B, 26C. It may also occur if the vehicle 22 with the transponder 20 changes its lane position. It will be understood that it will typically be unnecessary to program the transponder 20 each time a memory content signal 318 is received from a given transponder. Accordingly, the AVI reader 17 may be configured to ignore subsequent memory content signals 318 that are received after the transponder 20 has been successfully programmed.

Following the transmission of the programming signal 320*b*, 320*c* in the normal mode, the AVI reader 17 is configured to attempt to verify that the programming signal 320*b*, 320*c* was received correctly by the transponder 20. In one embodiment (not shown), to verify that the transponder 20 was successfully programmed, the AVI reader 17 transmits an additional trigger signal on the antenna 18A, 18B, 18C determined by the vehicle position determination system to be the most suitable for communicating with the transponder 20 and waits for a predetermined period of time for a response signal from the transponder 20. Typically, the response signal contains data stored in the memory of the transponder 20. If no response signal is received by the AVI reader 17 during the predetermined time period, the AVI reader 17 assumes that the transponder 20 has failed to update its memory.

In the embodiment illustrated in FIG. 2, an additional trigger signal is not required in order to verify that the transponder 20 was programmed. In this embodiment, the transponder 20 is configured to transmit a response signal 322 after it has received a programming signal 320 and has updated its memory. The AVI reader 17 monitors the period of time following the transmission of a programming signal 320. If the AVI reader 17 has not received a response signal 322 after a predetermined period of time following the transmission of the programming signal 320, the AVI reader 17 determines that the transponder 20 has failed to update its memory. For example, in FIGS. 2 and 3, the second frame 342 of the first superframe 330 illustrates an example in which a response signal is not received following the transmission of the programming signal 320*b*. In this example, the AVI reader 17 would determine that the transponder 20 has failed to update its memory.

The AVI reader 17 may also be configured to determine that the transponder 20 has failed to update its memory if the response signal 322 is different than it would have been if the transponder 20 had been programmed properly. The AVI reader 17 may be configured to compare the response signal 322 to an expected response signal to determine whether the transponder 20 has updated its memory using the programming signal 320. This situation is illustrated in the third frame 344 of the first superframe 330 of FIG. 2. Here, the response signal 322*c* is not as expected and the AVI reader 17 determines that the transponder 20 has failed to update its memory.

Figure 3:
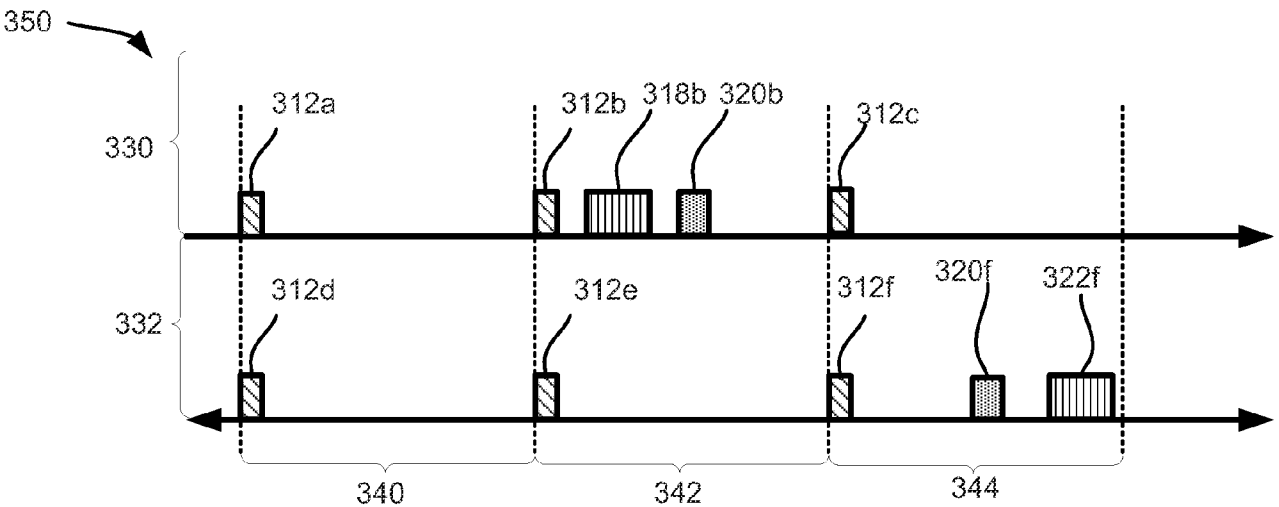
FIG. 3 shows a timing diagram of another embodiment of a control device for use with the transponder communication system of FIG. 1.

In the embodiments shown in FIGS. 2 and 3, the AVI reader 17 is configured to direct at least one of the antennas 18A, 18B, 18C to transmit the programming signal 320*e*, 320*f* in an enhanced mode if the AVI reader 17 determines that the transponder 20 failed to update its memory. In the enhanced mode, the programming signal 320*e*, 320*f* is transmitted over a modified coverage area. That is, it is transmitted over a coverage area that is different than the coverage area 26A, 26B, 26B over which the programming signal 320 was transmitted in the normal mode.

Figure 4:
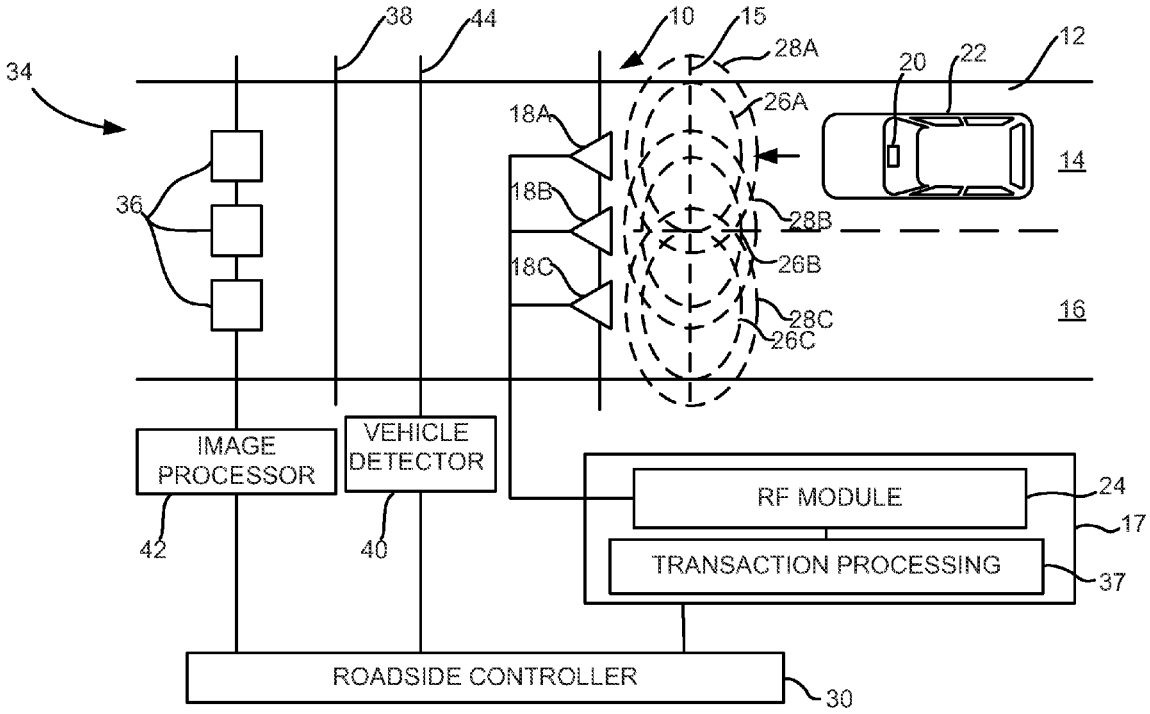
FIG. 4 shows a plan view and a block diagram of an embodiment of a transponder communication system in a two-lane open road toll application.

Referring now to FIGS. 2 and 4, in one embodiment, in the normal mode, the AVI reader 17 is configured to cause the programming signal 320*b*, 320*c* to be transmitted at a normal power level, and in the enhanced mode, the AVI reader 17 is configured to cause the programming signal 320*e*, 320*f* to be transmitted at a power level that is greater than the normal power level. In the normal mode, the antennas 18A, 18B, and 18C will have standard coverage areas 26A, 26B, 26C. In the enhanced mode, the programming signal will be transmitted over a modified coverage area 28A, 28B, 28C of one of the antennas 18A, 18B, 18C.

Increasing the power level of a signal transmitted on one of the antennas 18A, 18B, or 18C effectively increases the size of the coverage zone 26A, 26B, 26C associated with that antenna 18A, 18B, 18C. The modified coverage areas 28A, 28B and 28C are larger than the standard coverage areas 26A, 26B, 26C. The larger coverage areas permit the AVI reader 17 to communicate with transponders 20 that may be outside of the standard coverage area 26A, 26B, or 26C. Increasing the power level of the programming signal will also result in a greater likelihood that the signal will be impervious to errors caused by attenuation or interference.

The antennas 18A, 18B, 18C may be connected to attenuators (not shown) which are used to vary the signal power level between the normal power level and the enhanced power level. The attenuators are controlled by the AVI reader 17, allowing the AVI reader 17 to vary the power level.

Referring now to FIG. 3 in conjunction with FIG. 1, another embodiment of the transponder communication system 10 is shown. In this embodiment, there are at least two antennas 18A, 18B, 18C. The AVI reader 17 is configured such that, in the normal mode, the programming signal 320 is transmitted using one of the antennas 18A, 18B, 18C. The various techniques discussed above, such as the use of a vehicle position determination system, may be employed to determine which of the antennas 18A, 18B or 18C to use to transmit the programming signal in the normal mode. In the enhanced mode, the AVI reader is configured to transmit the programming signal 320*f* using an antenna 18C or 18A that is adjacent to the antenna 18B used to transmit the programming signal 320*b* in the normal mode. For example, in the exemplary timing diagram 350 of FIG. 3, a programming signal 320*b* is transmitted in the second frame 342 of the first superframe 330 in the normal mode. Since the second frame 342 in this example corresponds to the second antenna 18B, the programming signal 320*b* is transmitted using the second antenna 18B in the normal mode. Since no response signal is received by the AVI reader 17, the AVI reader 17 determines that the transponder 20 failed to update its memory. Since the transponder 20 has failed to update its memory, the AVI reader 17 is configured to transmit another programming signal 320*f* in the enhanced mode. In this embodiment, in the enhanced mode, the programming signal 320*f* is transmitted using one of the antennas 18A, 18C that is adjacent to the antenna 18B used to transmit the programming signal 320*b* in the normal mode.

Where there is more than one antenna 18A, 18B, or 18C that is adjacent to the antenna 18A, 18B, 18C used to transmit the programming signal 320*b* in the normal mode, the AVI reader 17 may be configured to randomly select one of the antennas 18A, 18B, 18C that is adjacent to the antenna 18A, 18B, 18C used to transmit the programming signal 320*b* in the normal mode. Other methods of selection are also possible.

Figure 5:
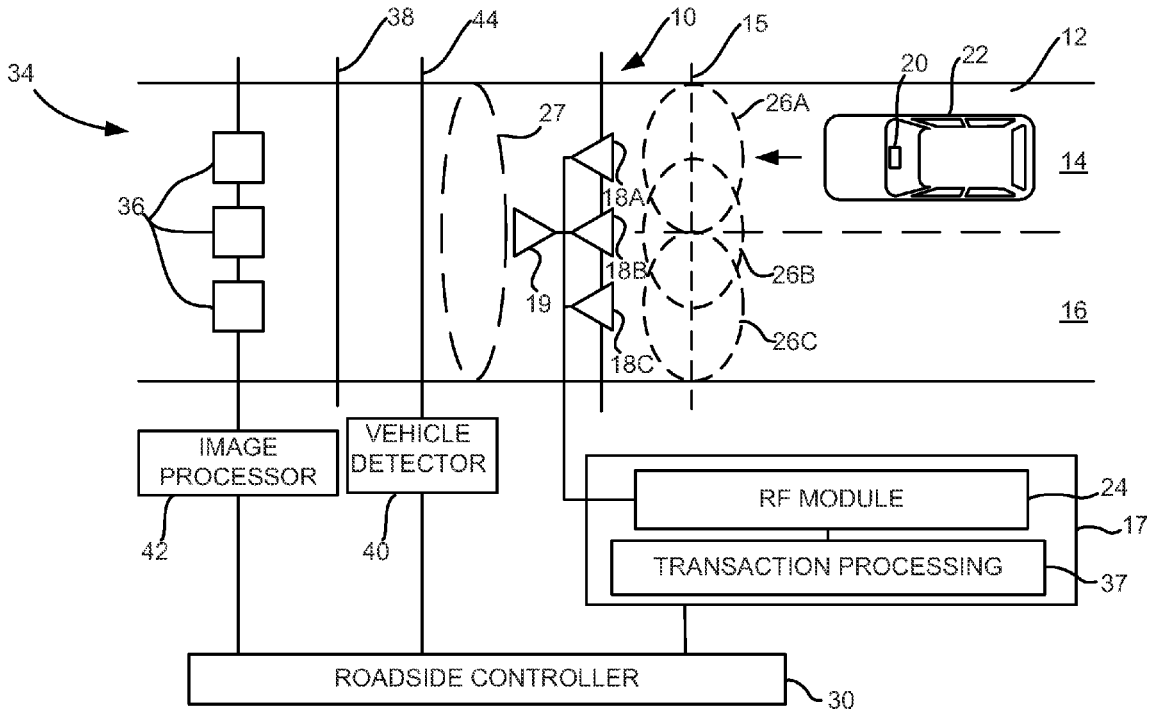
FIG. 5 shows a plan view and a block diagram of an example embodiment of a transponder communication system having a wide beam antenna.

In yet another embodiment, shown in FIG. 5, the transponder communication system 10 further includes narrow beam antennas 18A, 18B, 18C and at least one wide beam antenna 19. The wide beam antenna 19 has a coverage area 27 that is larger than the coverage area 26A, 26B, 26C of any one of the narrow beam antennas 18A, 18B, 18C. In this embodiment, the AVI reader 17 may be configured to transmit the programming signal using one of the narrow beam antennas 18A, 18B, 18C in the normal programming mode, and to transmit the programming signal using the wide beam antenna 19 in the enhanced mode. In some embodiments, the coverage zone 27 of the wide beam antenna 19 is downstream from the coverage zones 26A, 26B, 26C of the narrow beam antennas. In other embodiments (not shown), the coverage zone 27 of the wide beam antenna 19 overlaps the coverage zones 26A, 26B, 26C of the narrow beam antennas 18A, 18B, 18C.

In other embodiments (not shown), a combination of the methods of programming discussed above may be used. For example, in one embodiment, in the enhanced mode, the AVI reader 17 may be configured to both transmit the programming signal at a power level that is greater than the power level used in the normal mode and to transmit the programming signal on an antenna 18A, 18B, 18C that is adjacent to the antenna 18A, 18B, 18C that is used to transmit the programming signal in the normal mode.

While FIGS. 2 and 3 each illustrate embodiments in which the AVI reader 17 is configured to transmit a programming signal 320*e*, 320*f* in the enhanced mode after a single failed transmission of the normal programming signal 320*b*, 320*c*, it will be understood that the AVI reader 17 may be configured to transmit the programming signal 320*e*, 320*f* in the enhanced mode after any number of failed transmissions of the normal programming signal.

Following the transmission of the programming signal 320*e*, 320*f* in the enhanced mode, the AVI reader 17 may once again attempt to verify that the transponder 20 was successfully programmed. As before, the process of verification may include the step of transmitting a trigger signal and awaiting a response from the transponder 20. Alternatively, as demonstrated in the third frame 344 of the second superframe 332 of FIGS. 2 and 3, the transponder 20 may be configured to transmit the response signal 322*e*, 322*f* when it has been successfully programmed.

While FIGS. 2 and 3 each illustrate a situation in which there is only one failed attempt to program a given transponder 20, it will be understood that multiple failed attempts to program a given transponder 20 are also possible. The AVI reader 17 may be configured to deal with multiple failures in a variety of ways. In one embodiment, the AVI reader 17 is configured to track the total number of failed attempts or the time period during which the AVI reader 17 has been attempting to program the transponder 20. The AVI reader 17 will stop attempting to program the transponder 20 after a predetermined elapsed period of time or a predetermined number of programming attempts is reached, after which the AVI reader 17 will determine that the transponder 20 is outside of the coverage zone 26A, 26B, or 26C of the antennas 18A, 18B, or 18C. In some situations, the AVI reader 17 will stop attempting to program the transponder 20 after one programming signal 320*b*, 320*c* has been transmitted in the normal mode and one programming signal 320*e*, 320*f* has been transmitted in the enhanced mode.

In one embodiment, the AVI reader 17 may be configured to alternate between transmitting the programming signal 320*e*, 320*f* in the enhanced mode and transmitting the programming signal 320*b*, 320*c* in the normal mode after each successive failed programming attempt. For example, if a normal programming signal is transmitted using the first antenna 18A in the normal mode, the AVI reader 17 may be configured to transmit the programming signal in the enhanced mode using the second antenna 18B after a first failed programming attempt, and to again transmit the programming signal in the normal mode using the first antenna 18A after a second failed programming attempt.

Figure 6:
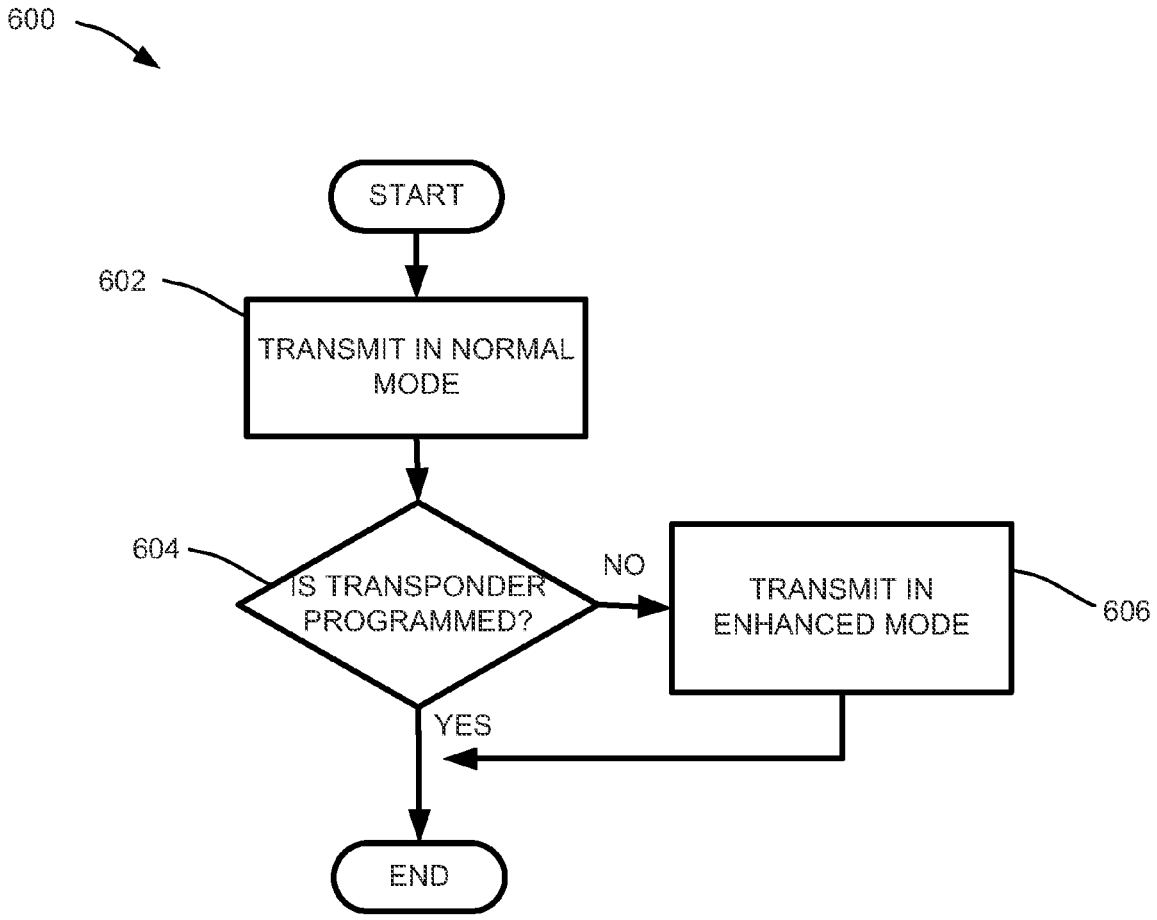
FIG. 6 shows a flow diagram of a method of communicating with a transponder according to one aspect of the present application.

Referring now to FIG. 6, example operations 600 of a method for programming a transponder 20 in accordance with one embodiment of the present disclosure will be described. In the first step 602, a programming signal 320 is transmitted in a normal mode over a coverage area 26A, 26B, 26C on at least one of the antennas 18A, 18B, 18C.

Next, in step 604 a determination is made as to whether the transponder 20 has been programmed using the programming signal 320. If the transponder 20 has not been programmed, or if it cannot be determined whether the transponder 20 has been programmed, at step 606 an attempt is made to program the transponder in the enhanced mode.

In one embodiment, in the normal mode of step 602, the programming signal 320 is transmitted at a normal power level and, in the enhanced mode of step 606, the programming signal 320 is transmitted at a power level that is greater than the normal power level.

In another embodiment, in the enhanced mode of step 606, the programming signal 320 is transmitted on an antenna 18A, 18B, 18C that is adjacent to the antenna 18A, 18B, 18C used in the step 602 of transmitting the programming signal 320 in the normal mode.

In some embodiments, the step 604 of verifying whether the transponder 20 has been programmed includes steps of monitoring the elapsed time following the transmission of the programming signal 320 in the normal mode and a step of determining that the transponder has not been programmed if the response signal 322 is not received after a predetermined period of time following the transmission of the programming signal.

In embodiments where the transponder 20 is configured to transmit a response signal 322 containing data stored in the memory of the transponder 20 when the transponder 20 receives a trigger signal, the step 604 of verifying whether the transponder 20 has been programmed includes steps of transmitting a trigger signal and monitoring the elapsed time following the transmission of the trigger signal and a step of determining that the transponder 20 has not been programmed if the response signal is not received after a predetermined period of time following the transmission of the trigger signal.

The method may also include a step (not shown) of re-attempting to verify that the memory of the transponder 20 has been programmed using the programming signal 320 following the transmission of the programming signal 320 in the enhanced mode in step 606.

In some embodiments, the step of transmitting the programming signal 320 in the enhanced mode includes a step of determining whether the antenna 18A, 18B, or 18C used to transmit the programming signal 320 in the normal mode is adjacent to more than one antenna 18A, 18B, 18C, and a step of selecting one of the antennas 18A, 18B, or 18C adjacent to the antenna used to transmit the programming signal 320 in the normal mode. The method further includes a step of transmitting the programming signal 320 on the selected antenna 18A, 18B, or 18C if the antenna 18A, 18B, or 18C used to transmit the programming signal 320 in the normal mode was adjacent to more than one antenna 18A, 18B, or 18C. The method also includes a step of transmitting the programming signal on the antenna 18A, 18B, 18C adjacent to the antenna 18A, 18B, 18C used in the normal mode if the antenna 18A, 18B, or 18C used in the normal mode was only adjacent to one antenna 18A, 18B, or 18C.

In the embodiment illustrated in FIGS. 2 and 3, each frame has an equal fixed length which is large enough to permit a reading operation and a programming operation to occur in each frame. In other embodiments, a structured timing structure may be used in which some of the frames do not allow for programming operations. By eliminating programming operations in some frames, the system allows for a higher scan rate of transponders 20. That is, a greater number of read operations may be performed. Also, by utilizing a structured timing structure, the system will have predictability. Predictability may be desirable to allow the AVI reader 17 to synchronize with other components in the system. For example, other AVI readers.

Figure 7:
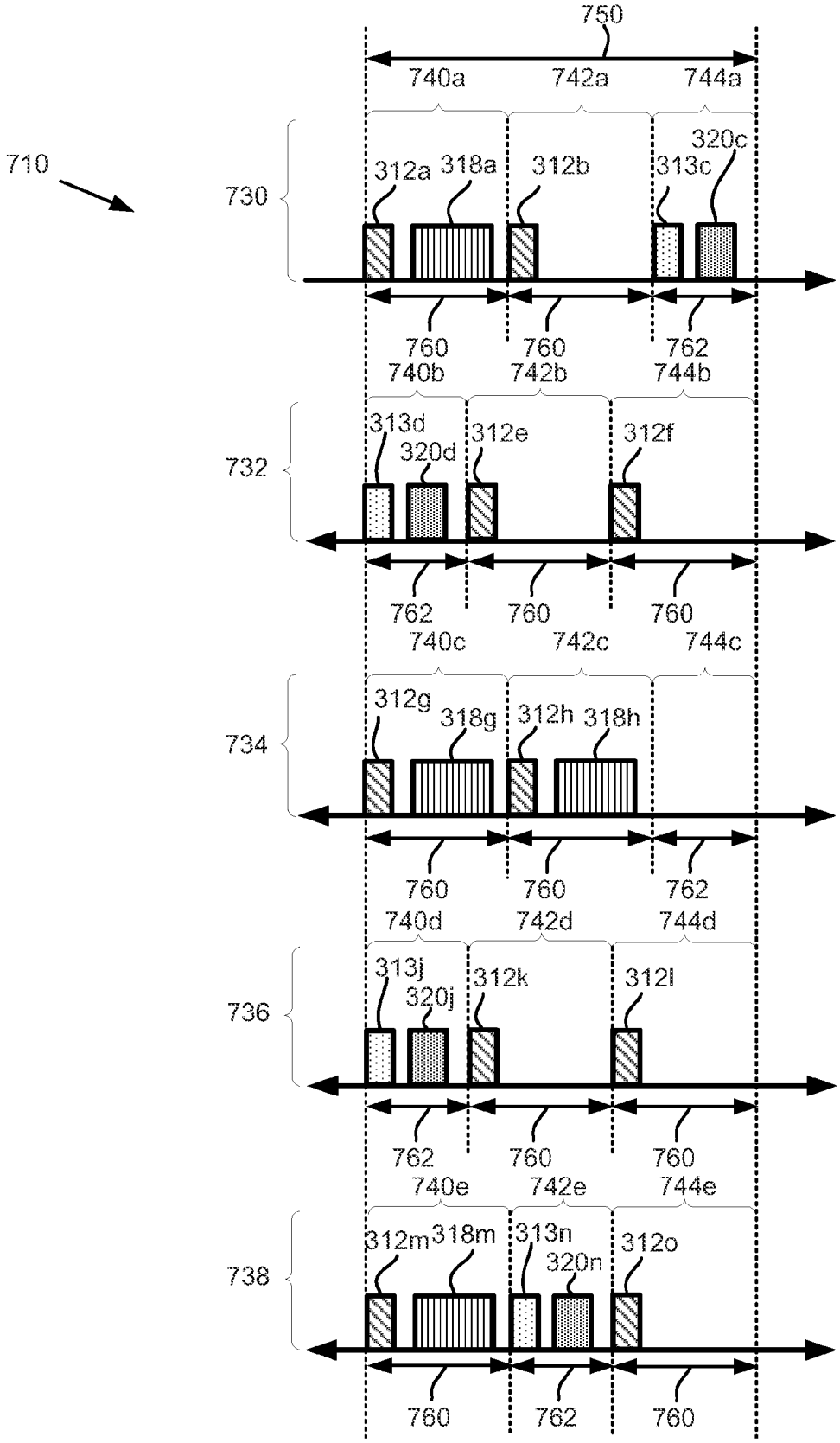
FIG. 7 shows an exemplary timing diagram of an embodiment of a control device for use with the transponder communication system of FIG. 1.

Referring now to FIG. 7, a timing diagram 710 for a transponder communication system 10 for use in an electronic toll collection system in accordance with another embodiment of the present disclosure is illustrated. In this embodiment, the AVI reader 17 is configured to operate the antennas 18A, 18B, 18C in a time division multiplexed sequence. As illustrated in FIG. 7, the time division multiplexed sequence has successive superframes 730, 732, 734, 736, 738 of equal duration 750. Each superframe 730, 732, 734, 736, 738 includes a series of frames 740, 742, 744. Within each superframe 730, 732, 734, 736, 738, each frame 740, 742, 744 corresponds to communications on a different one of the antennas 18A, 18B, or 18C. For example, in the embodiment illustrated in FIG. 7, each superframe 730, 732, 734, 736, 738 is comprised of three frames 740, 742, 744. Each of the three frames 740, 742, 744 corresponds to communications on a different one of the antennas 18A, 18B, 18C. For example, the first frames 740 correspond to communications on the first antenna 18A, the second frame 742 corresponds to communications on the second antenna 18B, and the third frames 744 correspond to communications on the third antenna 18C.

The AVI reader 17 is configured to allocate a predetermined number of the frames 740, 742, 744 in each superframe 730, 732, 734, 736, 738 as reading slots 740*a*, 742*a*, 742*b*,

744*b*, 740*c*, 742*c*, 742*d*, 744*d*, 740*e*, 744*e* for reading data from the memory of the transponders 20. The AVI reader 17 is also configured to allocate a predetermined number of frames 740, 742, 744 in each superframe 730, 732, 734, 736, 738 for programming. The frames 744*a*, 740*b*, 744*c*, 740*d*, 740*e* which are allocated for programming each include a writing slot for transmitting programming signals to the transponders 20 so that data may be written to the memory of the transponders 20. The predetermined number of frames to be allocated for programming will depend on the system and will vary based on the number of vehicles 22 typically passing through the coverage zones 26A, 26B, 26C. The predetermined number of frames to be allocated for programming should be selected to ensure that there are sufficient writing slots to enable each transponder 20 passing through the electronic toll collection system to be programmed before it leaves the coverage zones 26A, 26B, 26C. In some embodiments, the predetermined number of frames to be allocated as writing slots is one frame.

As illustrated in FIG. 7, each reading slot 740*a*, 742*a*, 742*b*, 744*b*, 740*c*, 742*c*, 742*d*, 744*d*, 740*e*, 744*e* in each superframe 730, 732, 734, 736, 738 is of equal duration 760. Reading slots are of sufficient duration to allow for reading of a transponder 20, but are not of sufficient duration to allow for both reading of a transponder 20 and writing to a transponder 20.

Each frame that is allocated for programming 744*a*, 740*b*, 744*c*, 740*d*, 740*e* in each of the superframes 730, 732, 734, 736, 738 is of equal duration 762. These frames are of sufficient duration to permit a programming signal 320 to be transmitted. In some embodiments, each of the frames which is allocated for programming also includes sufficient time to permit a reading operation to occur. These frames may also include sufficient time to permit a verification operation to occur, wherein the AVI reader 17 attempts to verify that data was correctly programmed to the transponder 20.

The AVI reader 17 is configured to allocate an equal number of frames in successive superframes 730, 732, 734, 736, 738 as reading slots and to allocate an equal number of frames in successive superframes 730, 732, 734, 736, 738 for programming. In the example shown in FIG. 7, two frames of each superframe have been allocated as reading slots and one frame in each superframe has been allocated for programming. In the example shown, the frames that are allocated for programming are of sufficient duration to permit programming of the transponder 20 but are not of sufficient duration to permit reading the transponder 20.

As noted above, the transponder communication system 10 according to the embodiment of FIG. 7 does not require that each frame allow for both a read operation and a programming operation. In contrast, in the system shown in FIG. 2, sufficient time is allocated in each frame 340, 342, 344 for a programming operation, even if such an operation is not required. The duration 750 of each superframe 730, 732, 734, 736, 738 is less than the duration of each superframe 330, 332 in the system shown in the embodiment of FIG. 2. By minimizing the duration 750 of the superframes using the timing scheme shown in FIG. 7, the transponder communication system 10 allows for a faster scan rate of transponders 20. That is, the period of time between successive reads on a given antenna 18A, 18B, 18C is reduced.

Typically, the duration 762 of the frames 744*a*, 740*b*, 744*c*, 740*d*, 740*e* allocated for programming is different than the duration of the frames 740*a*, 742*a*, 742*b*, 744*b*, 740*c*, 742*c*, 742*d*, 744*d*, 740*e*, 744*e* allocated as reading slots. In many systems, the AVI reader 17 will cause the antennas 18A, 18B, 18C to transmit as the programming signal 320 a subset of the data that is transmitted from the transponder 20 to the AVI reader 17 as the memory content signal 318. The programming signal 320 may only contain data which has been updated and an identifier associated with the transponder 20. The identifier is used to ensure that the memory is only updated in the intended transponder 20. Therefore, in many systems, the duration 760 of the reading slots is longer than the duration 762 of the frames reserved for programming 744*a*, 740*b*, 744*c*, 740*d*, 740*e*, 744*e*.

In the exemplary timing diagram 710 of FIG. 7, in the first superframe 730, the third frame 744*a* has been allocated for programming and the first and second frames 740*a*, 742*a* have been allocated as reading slots. In the reading slots of the first superframe 730, trigger signals 312*a*, 312*b* are transmitted using the antenna 18A, 18B which corresponds to the current frame.

As before, the transponder 20 is programmed to transmit a memory content signal 318 in response to the receipt of the trigger signal 312.

Following the transmission of the trigger signals 712, the AVI reader 17 is configured to wait a predetermined period of time for the memory content signal 318 to be received.

If the memory content signal 318 is received, as is the case of the first frame 740*a* of the first superframe 730 of FIG. 7, the AVI reader 17 will typically perform some processing operations on the received data. As discussed above, in some embodiments, the AVI reader 17 may contain a transaction processing module 37 for processing a payment transaction in response to the transmission of the memory content signal 318 by the transponder 20. The transaction processing module 37 may be configured to issue a request for programming the transponder 20 which transmitted the memory content signal 318 following the processing of the payment transaction for that transponder 20. The AVI reader 17 is configured to allocate one of the frames in the series of frames 740*b*, 742*b*, 744*b* for programming that transponder 20 after the AVI reader has received the request for programming that transponder 20.

For example, in the first frame of the first superframe 730 of FIG. 7, a memory content signal 318*a* is received by the AVI reader 17. Accordingly, the first frame 740*b* of the second superframe 732 is allocated as for programming. A frame that has been allocated for programming contains a writing slot for writing to the transponder 20.

In a writing slot, the AVI reader 17 may be configured to transmit a wake up signal 313*c*, 313*d*, 313*j*, 313*n* prior to transmitting the programming signal 320*c*, 320*d*, 320*j*, 320*n*. The wake up signal 313*c*, 313*d*, 313*j*, 313*n* causes the transponder 20 to awaken from a sleep state and readies it for receiving the programming signal 320*c*, 320*d*, 320*j*, 320*n*. Following the transmission of the wake up signal, the AVI reader may be configured to wait a predetermined period of time before transmitting the programming signal 320.

In other embodiments, wake up signals may not be used. In such embodiments, the AVI reader 17 may simply transmit the programming signal 320*c*, 320*d*, 320*j*, 320*n* during the writing slots.

In some circumstances, there may be a greater number of transponders 20 which need to be programmed than there are writing slots. This situation is illustrated in the third superframe 734 of FIG. 7. In this example, a memory content signal 318*g* is received from a first transponder in a first coverage zone 26A associated with the first frame 740*c*. A memory content signal 318*h* is also received from a second transponder in a second coverage zone 26B associated with the second frame 742*c*. In such circumstances, the AVI reader 17 may be configured to allocate frames for programming in the order that requests for programming have been received. In the example shown, since the memory content signal 318*g* for the first frame 740*c* is received prior to the memory content signal 318*h* for the second frame 742*c*, it is likely that the transaction processing module 37 will process the transaction for the first transponder before it processes the transaction for the second transponder. In this case, the first frame 740*d* of the fourth superframe 736 will be allocated for programming the first transponder. The second frame 742*e* of the fifth superframe 738 is then allocated for programming the second transponder.

In other embodiments, the AVI reader 17 is configured to determine a probable order in which the transponders will exit the coverage area 26A, 26B, 26C of the antennas 18A, 18B, 18C and will prioritize programming requests based on the probable order. The AVI reader 17 may be configured to track an elapsed period of time following the first instance or point in time that the data in the memory of each transponder 20 is read. Assuming that all vehicles are traveling at approximately the same speed, the probable order may be determined based on the elapsed period of time.

In other embodiments, the AVI reader 17 may be configured to determine the probable order that transponders will exit the coverage area by tracking the total number of instances that the data in the memory of each transponder is read. The transponder whose memory has been read the greatest number of times will be determined to be the transponder which will leave the coverage area 26A, 26B, 26C first.

The AVI reader 17 may also be configured to allocate a predetermined number of frames in each superframe 730, 732, 734, 736, 738 as verification slots for verifying that data has been written to the memory of the transponder 20 during one of the writing slots. In one embodiment, shown in FIG. 7, the AVI reader 17 may use any one of the reading slots to verify that data has been written to the memory of the transponder 20 during one of the writing slots. For example, the first frame 740*c* of the third superframe 734 of FIG. 7 is used as a verification slot.

Figure 8:
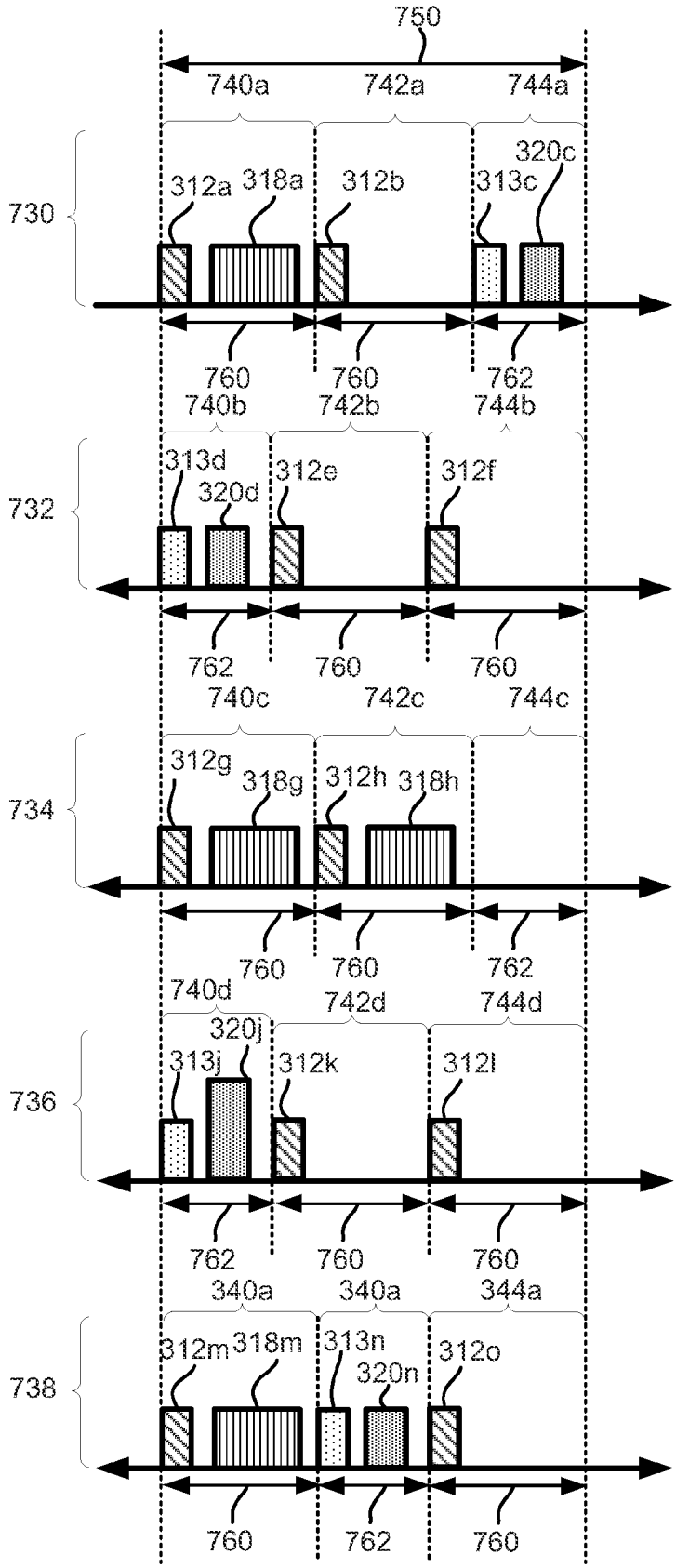
FIG. 8 shows an exemplary timing diagram of an embodiment of a control device for use with the transponder communication system of FIG. 4.

In yet a further embodiment, shown in FIG. 8, the time division multiplexed sequence discussed above with reference to FIG. 7 is modified to include the enhanced mode of programming discussed earlier. In this embodiment, after the AVI reader 17 has transmitted a programming signal 320 in a normal mode (which is shown as occurring in the second superframe 732) it is configured to verify whether one of the transponders has updated its memory from the programming signal 320. The verification is shown as occurring in the third superframe 734. If the AVI reader 17 determines that the transponder 20 has failed to update its memory, the AVI reader 17 will cause the programming signal 320 to be transmitted in an enhanced mode. In the enhanced mode, the transmission of the programming signal 320 occurs over a different coverage area than in the normal mode. In the example shown in FIG. 8, the programming signal 320*j* is transmitted in the enhanced mode in the fourth superframe 736. In the enhanced mode, the programming signal 320 may be transmitted at a power level that is greater than the power level used to transmit the programming signal in the normal mode.

Figure 9:
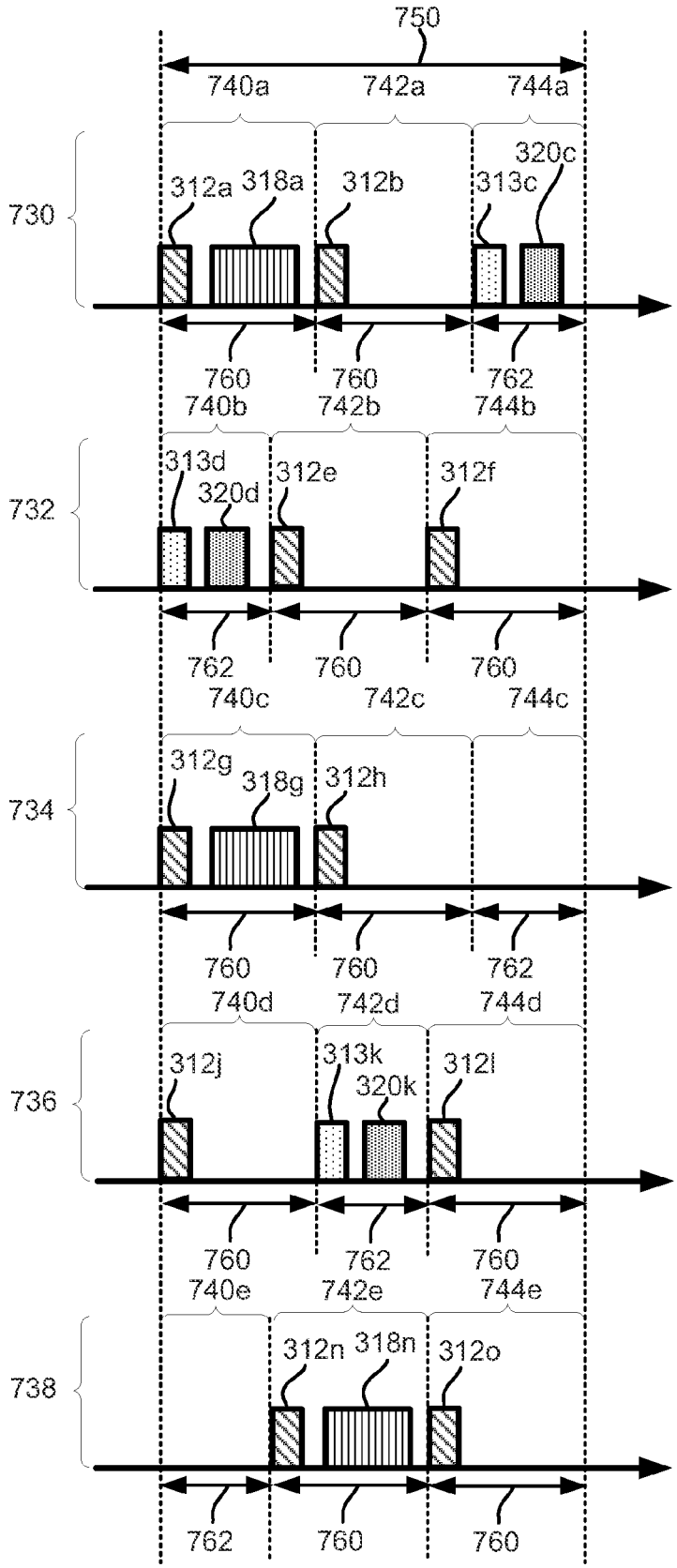
FIG. 9 shows an exemplary timing diagram according to another embodiment of a control device for use with the transponder communication system of FIG. 1.

In another embodiment, shown in FIG. 9, in the enhanced mode, the AVI reader 17 is configured to transmit the programming signal 320 on an antenna 18A, 18B, 18C that is adjacent to the antenna 18A, 18B, 18C used to transmit the programming signal 320 in the normal mode. In the example illustrated, after the AVI reader 17 has transmitted a programming signal 320*d* in a normal mode in the second superframe 732, it verifies whether one of the transponders has updated its memory from the programming signal 320*d*. In the example shown, the verification step is performed in the third superframe 734. In this case, the AVI reader 17 determines that the transponder 20 has failed to update its memory and causes the programming signal 320*k* to be transmitted in the enhanced mode in the fourth superframe 736. In the enhanced mode, the transmission of the programming signal 320*k* occurs in the second frame since it corresponds to the antenna 18B which is adjacent to the antenna 18A used to transmit the programming signal 320*k* in the normal mode.

Figure 10:
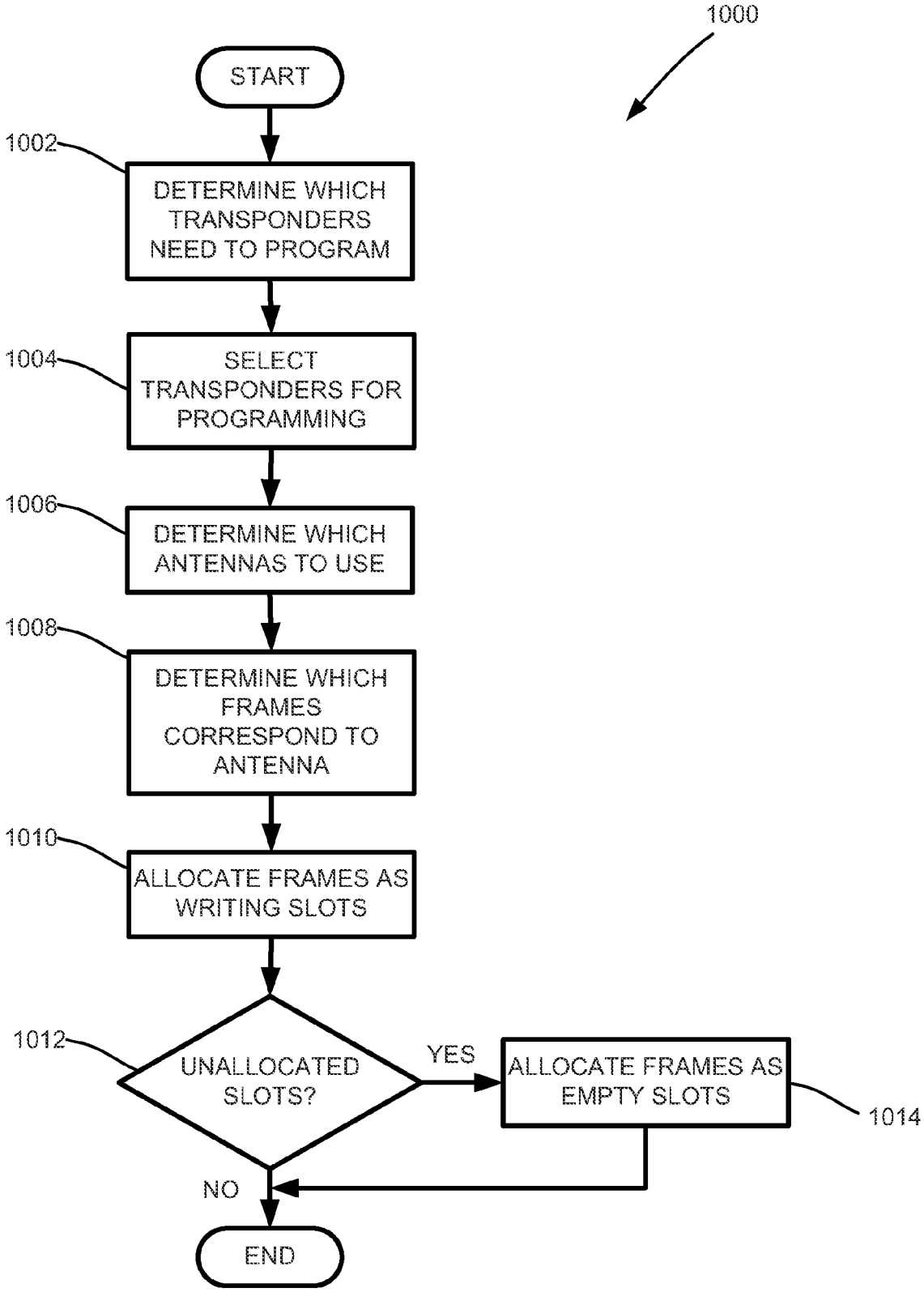
FIG. 10 shows a flow diagram of a method of communicating with a transponder located in the system of FIG. 1.

Referring now to FIG. 10, example operations 1000 of a method of directing communications with transponders in accordance with one embodiment of the present disclosure will be described. The method is for use in a system in which antennas 18A, 18B, 18C are configured to operate in a time division multiplexed sequence. As described above, with reference to FIG. 7, the time division multiplexed sequence is comprised of successive superframes 730, 732, 734, 736, 738. Each superframe is comprised of a series of frames 740, 742, 744, each corresponding to communications on one of the antennas 18A, 18B, 18C. Each superframe 730, 732, 734, 736, 738 has a fixed number of frames available for reading data from a memory of the transponder 20 and a fixed number of frames available for writing data to the memory of the transponder 20. In the first step 1002, a determination is made regarding which of the transponders 20 need to be programmed. Next, at step 1004, some of the transponders 20 are selected for immediate programming based on the fixed number of frames available for writing data. The number of transponders 20 selected for immediate programming cannot be greater than the number of frames available for writing data.

At step 1006, a determination is made as to which of the antennas 18A, 18B, 18C should be used to communicate with the transponder that needs to be programmed. As described above, a variety of methods may be used to determine which of the antennas 18A, 18B, 18C is best suited for communicating with a specific transponder. For example, a vehicle position determination system may be used.

At step 1008, a determination is made as to which frames of a first superframe correspond to the antenna 18A, 18B, 18C that has been determined to be best suited for communicating with the transponder 20. At step 1010, the frames which have been determined to correspond to the antenna 18A, 18B, 18C are allocated for programming data to the memory of the transponder.

The method may also include the optional steps 1012, 1014 of determining whether there are unallocated frames and allocating all unallocated frames as empty slots. Allocating frames as empty slots serves to maintain the fixed superframe structure described above by ensuring that the duration of all superframes is the same. Having a fixed superframe structure may advantageous in many systems. For example, a predictable fixed superframe structure may be necessary in systems having more than one AVI reader 17 to allow the AVI readers to have synchronized communications.

In some systems, it may be possible to allocate the unallocated frames as reading slots. This will be possible if the duration 760 of the reading slots is less than the duration 762 of the frames reserved for programming.

Figure 11:
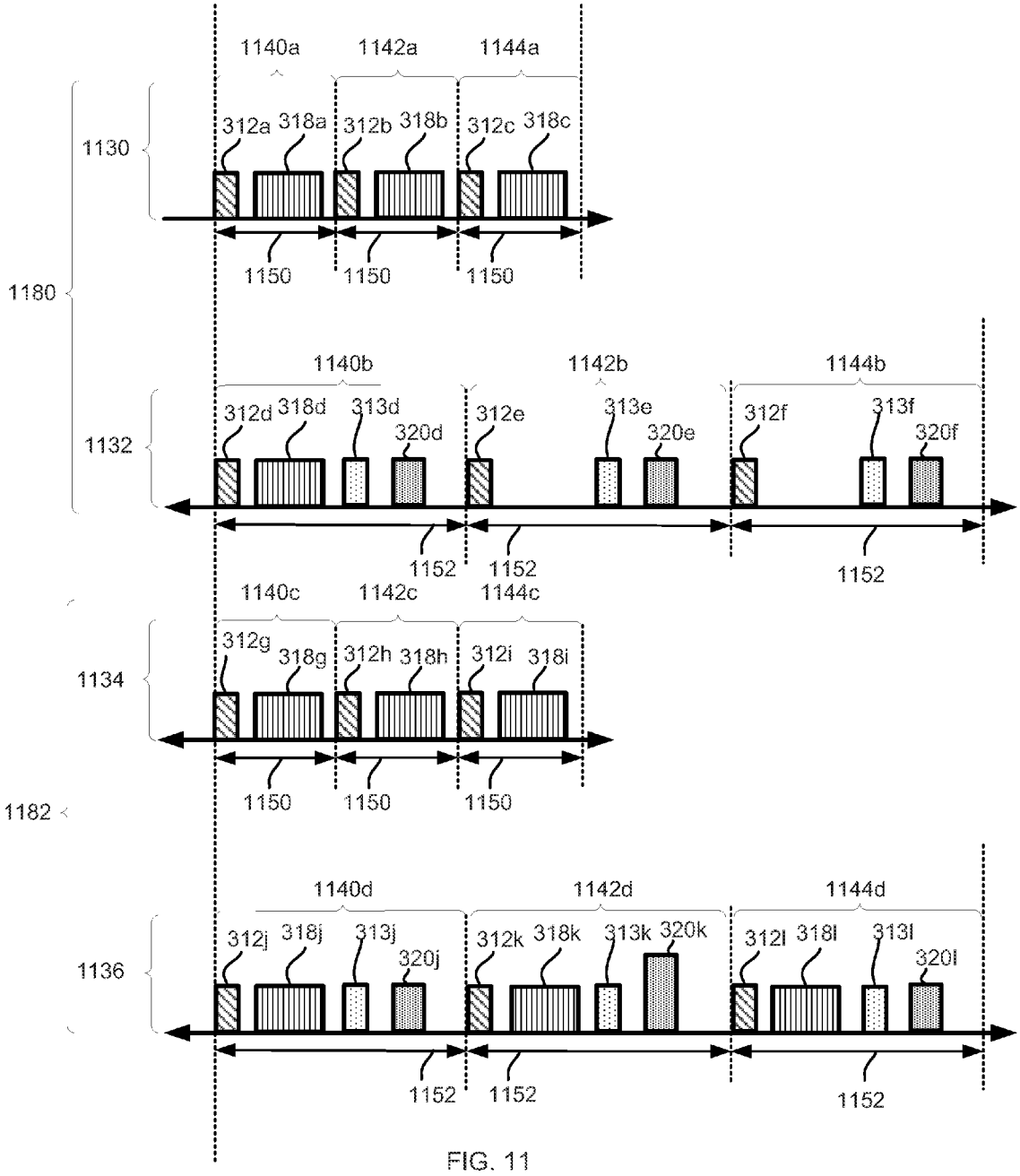
FIG. 11 shows a timing diagram of an embodiment of a control device for use with the transponder communication system of FIG. 4.

Another embodiment of the present disclosure is illustrated at FIG. 11. The AVI reader 17 is configured to operate in a time division multiplexed sequence. In this embodiment, the time division multiplexed sequence has successive hyperframes 1180, 1182. Each hyperframe 1180, 1182 is of equal duration and each hyperframe 1180, 1182 is comprised of a series of superframes 1130, 1132 and 1134, 1136. The series of superframes 1130, 1132 and 1134, 1136 includes a first superframe 1130, 1134 comprised of a series of frames 1140*a*, 1142*a*, 1144*a* and 1140*c*, 1142*c*, 1144*c*. Each frame 1140*a*, 1142*a*, 1144*a* and 1140*c*, 1142*c*, 1144*c* in the first superframe 1130, 1134 corresponds to a period for communicating on a different one of the antennas 18A, 18B, 18C. Each frame 1140*a*, 1142*a*, 1144*a* and 1140*c*, 1142*c*, 1144*c* in the first superframe is a reading slot for reading data from the memory of the transponders 20.

Each series of superframes 1130, 1132 and 1134, 1136 also has a second superframe 1132, 1136. The second superframes 1132, 1136 of each hyperframe 1180, 1182 are comprised of a second series of frames 1140*b*, 1142*b*, 1144*b* and 1140*d*, 1142*d*, and 1144*d*. Each frame in the second series of frames corresponds to a period for communicating on a different one of the antennas 18A, 18B, 18C. Each frame in the second superframe 1132, 1136 includes a writing slot for writing data to the memory of the transponders 20. Each frame in the second superframe may also include a reading slot for reading data from the memory of the transponders 20.

In each of the frames 1140*a*, 1142*a*, 1144*a* and 1140*c*, 1142*c*, 1144*c* of the first superframes 1130, 1134, the duration 1150 of the frames is sufficient to permit a reading operation to be performed, but not sufficient to permit both reading and programming operations to be performed. The duration 1152 of the frames 1140*b*, 1142*b*, 1144*b* and 1140*d*, 1142*d*, and 1144*d* of the second superframe 1132, 1136 is sufficient to permit both reading operations and programming operations to be performed. Each frame 1140*a*, 1142*a*, 1144*a* and 1140*c*, 1142*c*, 1144*c* that is a reading slot is the same duration 1150 and each frame 1140*b*, 1142*b*, 1144*b* and 1140*d*, 1142*d*, and 1144*d* that includes a writing slot is of the same duration 1152. Each writing slot is of equal duration.

The duration of the writing slots may be different than the duration of the reading slots since the programming signal that is transmitted during a writing slot may include only the data from the data received during a reading slot that has changed. Accordingly, in some embodiments, the duration of the reading slots may be longer than the duration of the writing slots.

In some embodiments (not shown), each hyperframe may further include a third superframe, which is comprised of a series of frames. Each frame in the third superframe corresponds to a period for communicating on a different one of the antennas. Each frame in the third superframe includes a verification slot for verifying that data has been written to the memory of the transponder 20. The third superframe may also include a reading slot for reading data from the memory of the transponders. The third superframe may also include a writing slot for writing data to the memory of the transponders 20. The duration of each frame in the third superframe is equal.

In other embodiments, each of the frames 1140*b*, 1142*b*, 1144*b* and 1140*d*, 1142*d*, and 1144*d* in the second superframes 1132, 1136 may include a verification slot for verifying that data has been written to the memory of the transponder 20. In each of these embodiments, the duration of each verification slot is equal.

In another embodiment, the AVI reader 17 may be configured to use any one of the reading slots for verifying that data has been written to the memory of the transponder during one of the writing slots. That is, a reading slot may also be used as a verification slot.

While FIG. 11 illustrates a system in which there are two superframes 1130, 1132 and 1134, 1136 in each hyperframe 1180, 1182, it will be appreciated that other variants may achieve the same result. For example, the series of superframes could comprise additional superframes. Each frame in the additional superframes could correspond to a period for communicating on a different one of the antennas. Each frame in the additional superframes may be reading slots for reading data from the memory of the transponders 20.

In any case, at least one frame in each hyperframe is of a duration that will permit the AVI reader 17 to read the contents of the memory of the transponder 20, but will not permit the AVI reader 17 to both read the contents of the memory of the transponder 20 and program the memory of the transponder. That is, in order to maximize the scan rate of the transponder communication system 10, the timing structure employed may be selected so that some of the frames do not provide sufficient time to perform both a reading operation where data is read from the memory of the transponder 20 and a programming operation where data is programmed to the memory of the transponder 20. Also, in order to provide predictability to the system to allow the system to work with external components, such as additional AVI readers, a timing structure may be employed which has a repetitive structure that is based on successive hyperframes or superframes of equal duration.

Referring to FIG. 11, when the current frame is a reading slot (as are any of the frames 1140*a*, 1142*a*, 1144*a*, 1140*c*, 1142*c*, 1144*c* in the first superframes 1130, 1134 of each hyperframe 1180, 1182), the AVI reader 17 is configured to transmit a trigger signal 312*a*, 312*b*, 312*c*, 312*g*, 312*h*, 312*i* on the antenna 18A, 18B, 18C which corresponds to the current frame and to subsequently wait for a response signal 318*a*, 318*b*, 318*c*, 318*g*, 318*h*, 318*i*, from one of the transponders 20.

The AVI reader 17 is configured to transmit a programming signal 320*d*, 320*e*, 320*f*, 320*j*, 320*k*, 320*l* on the antenna 18A, 18B, 18C corresponding to the current frame when the current frame is one of the writing slots. For example, each of the frames 1140*b*, 1142*b*, 1144*b* and 1140*d*, 1142*d*, and 1144*d* of the second superframes 1132, 1136 shown in FIG. 11 contain writing slots.

In the embodiment shown in FIG. 11, the AVI reader 17 is configured to transmit a wake up signal 313 on the antenna 18A, 18B, 18C, corresponding to a current frame when the current frame is one of the writing slots. The AVI reader 17 will then wait for a predetermined period of time before transmitting a programming signal on the antenna 18A, 18B, 18C corresponding to the current frame. As described above, the wake up signal may be used to awake the transponder 20 from a sleep mode and place it in a state in which it is ready to receive the programming signal 320.

In one embodiment, shown in FIG. 11, if a first programming attempt on an antenna 18A, 18B, or 18C is unsuccessful in a normal mode, then the programming signal 320 is transmitted in the enhanced mode. In the enhanced mode, the programming signal 320 may be transmitted at a power level that is greater than the power level used to transmit the programming signal 320 in the normal mode. In the embodiment shown, a programming signal 320*e* is transmitted in the second frame 1142*b* of the second superframe 1132 of the first hyperframe 1180. Subsequently, in the second frame 1142*c* of the first superframe 1134 of the second hyperframe 1182, the contents of the memory of the transponder 20 are re-read and it is determined that the memory did not properly update. Following this determination, at the next available opportunity to program the transponder 20, the programming signal 320*k* is transmitted in the enhanced mode. In the example shown, this occurs, in the second frame 1142*d* of the second superframe 1136 of the second hyperframe 1182, In other embodiments, as described above, in the enhanced mode the programming signal 320 may be transmitted using an antenna 18A, 18B, 18C that is adjacent to the antenna 18A, 18B, 18C used to transmit the programming signal 320 in the normal mode.

As discussed above, it may be desirable to be able to locate the vehicle 22 to one of the lanes 14, 16 in order to ensure that that the proper camera 36 is used and that any picture with the camera is of the correct vehicle 22. Accordingly, in many embodiments a vehicle position determination system (not shown) may be employed in order to determine the position of the vehicle 22. The vehicle position determination system typically determines a lane position of a vehicle 22 by monitoring which one of the antenna 18A, 18B, 18C the transponder 22 is communicating with. Accordingly, in many embodiments, the width of the coverage area 26A, 26B, 26C of the antennas 18A, 18B, 18C is less than or equal to the width of a lane 14, 16. In some systems, these antennas 18A, 18B, 18C may be used for both reading operations and programming operations. However, as discussed below, in some systems, reading operations and programming operations may be performed on different antennas.

Referring again to FIG. 5, an embodiment is shown in which the transponder communication system 10 includes narrow beam antennas 18A, 18B, 18C and at least one wide beam antenna 19. The wide beam antenna 19 has a coverage area 27 that is larger than the coverage area 26A, 26B, 26C of any one of the narrow beam antennas 18A, 18B, 18C and that includes at least a portion of the roadway 12.

The AVI reader 17 is configured to control communications on the narrow beam antennas 18A, 18B, 18C and the wide beam antenna 19 and is configured to initiate a reading sequence by causing one of the narrow beam antennas 18A, 18B, 18C to transmit a trigger signal 312 and await a response on that antenna. The AVI reader 17 is also configured to execute a writing sequence by causing the wide beam antenna 19 to transmit a programming signal 320 to the transponder 20.

The wide beam antenna 19 is used for programming operations since, for programming operations, it is not necessary to know the lane position of the vehicle. In contrast, reading operations use the narrow beam antennas 18A, 18B, 18C in order to allow the system to determine the lane position of the vehicle 22 in the roadway 12. Typically the lane position of the vehicle is determined by monitoring the number of times a memory content signal for a given transponder is received at each antenna 18A, 18B, 18C. In some embodiments, the wide beam antenna 19 is only used for transmitting programming signals 320. In such embodiments, the wide beam antenna 19 may be a unidirectional antenna.

The wide beam antenna 19 may also be used to transmit a wake up signal 313 prior to transmitting the programming signal in order to force a transponder 20 out of a low power sleep mode and into a state in which it is ready and able to receive a programming signal 313.

The AVI reader 17 may be configured to initiate a writing sequence only after the AVI reader 17 has received a request for programming the transponder 20 from the transaction processing module 37.

In some embodiments, such as the embodiment illustrated in FIG. 5, the wide beam antenna 19 is positioned downstream from the narrow beam antennas 18A, 18B, 18C relative to the direction of the vehicle 22 traveling on the roadway 12. The coverage area 27 of the wide beam antenna is also downstream from the coverage area 26A, 26B, 26C of the narrow beam antennas 18A, 18B, 18C so that a vehicle traveling on the roadway passes through the coverage area 26A, 26B, 26C of the narrow beam antennas 18A, 18B, 18C prior to passing through the coverage area 26A, 26B, 26C of the narrow beam antennas 18A, 18B, 18C.

In other embodiments (not shown), at least a portion of the coverage area 27 of the wide beam antenna 19 overlaps a portion of the coverage area 26A, 26B, 26C of one of the narrow beam antennas 18A, 18B, 18C. In order to minimize deployment costs, the wide beam antenna 19 may be mounted on the same overhead gantry or other structure that the narrow beam antennas 18A, 18B, 18C are mounted on.

In some embodiments, such as that shown in FIG. 5, there may be a single wide beam antenna 19 having a coverage area 27 that includes the width of the roadway 12. In other embodiments, multiple wide beam antennas may be used.

Following the transmission of the programming signal on the wide beam antenna 19, the AVI reader 17 may be configured to initiate a verification sequence. The AVI reader 17 initiates a verification sequence by causing at least one of the narrow beam antennas 18A, 18B, 18C to transmit a verification or trigger signal and waiting for a response from the transponder. Each transponder 20 is configured to transmit data from its memory in response to the receipt of a verification signal.

In other embodiments, the AVI reader 17 may be configured to initiate a verification sequence by causing the wide beam antenna 19 to transmit a verification or trigger signal and subsequently wait for a response from the transponder 20.

If a response to the verification or trigger signal is not received, or if the response is different than expected, the AVI reader 17 may determine that the transponder 20 has not been programmed.

Certain adaptations and modifications of the invention will be obvious to those skilled in the art when considered in light of this description. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A method of directing communications with transponders in moving vehicles in a roadway, the roadway having a plurality of antennas having a combined coverage area that includes at least a portion of the roadway, the antennas to operate in a time division multiplexed sequence, the time division multiplexed sequence being comprised of successive superframes, each superframe being comprised of a series of frames, each frame corresponding to communications on one of the antennas, each superframe having a fixed number of frames available for reading data from a memory of the transponder and a fixed number of frames available for writing data to the memory of the transponder, the method comprising:

determining which of the transponders need to be programmed;

selecting for immediate programming at least some of the transponders that need to be programmed based on the fixed number of frames available for writing data;

determining which of the antennas to use for communicating with the transponders that need to be programmed;

determining which frames correspond to the antennas to be used;

allocating the frames of a first superframe which have been determined to correspond to the antennas to be used as writing slots, for writing data to the memory of the transponder; and allocating a number of the unallocated frames of the superframe as reading slots, the frames allocated as reading slots not being used as writing slots.

2. The method of claim 1 further comprising:

allocating all unallocated frames as empty slots.

3. A transponder communication system for use in an electronic toll collection system for programming a transponder located in a moving vehicle travelling in a roadway, the transponder having a memory, the system comprising:

a plurality of narrow beam reading antennas, each antenna having a coverage area that includes at least a portion of the roadway and each antenna to transmit trigger signals and receive signals transmitted by the transponders in response to the trigger signal;

at least one wide beam programming antenna having a coverage area that includes at least a portion of the roadway and the wide beam programming antenna to transmit signals to the transponders, the coverage area of the wide beam antenna being larger than the coverage area of any one of the narrow beam antennas; and a control device connected to the antennas, the control device to control communications on the antennas, the control device to initiate a reading sequence by causing one of the narrow beam antennas to transmit a trigger signal and awaiting a response on that antenna, the control device to initiate a writing sequence by causing the wide beam antenna to transmit a programming signal.

4. The transponder communication system in claim 3 wherein the at least one wide beam antenna is positioned downstream from the narrow beam antennas relative to the direction of the vehicle travelling on the roadway.

5. The transponder communication system in claim 3 wherein at least a portion of the coverage area of each wide beam antenna overlaps a portion of the coverage area of one of the narrow beam antennas.

6. The transponder communication system of claim 3 wherein the at least one wide beam antenna is a single antenna having a coverage area that includes the width of the roadway.

7. The transponder communication system of claim 3 wherein the at least one wide beam antenna is a unidirectional antenna.

8. The transponder communication system of claim 3 wherein the control device is to cause the wide beam antenna to transmit a wake up signal prior to transmitting a programming signal.

9. The transponder communication system of claim 3, wherein the control device further comprises a transaction module to process a payment transaction in response to a receipt of data from the transponders at the narrow beam antennas, the transaction module to issue a request to program one of the transponders following the processing of the payment transaction for that transponder, wherein the control device is to initiate a writing sequence only after the control device has received the request for programming that transponder.

10. The transponder communication system in claim 9 wherein the control device comprises a microprocessor.

11. The transponder communication system of claim 3 wherein the control device is further to initiate a verification sequence subsequent to the writing sequence by causing at least one of the narrow beam antennas to transmit a verification signal and waiting for a response from the transponder.

12. The transponder communication system of claim 3 wherein the control device is further to initiate a verification sequence subsequent to the writing sequence by causing the at least one wide beam antenna to transmit a verification signal and waiting for a response from the transponder.

* * * * *